US006199642B1

(12) United States Patent
Becker et al.

(10) Patent No.: US 6,199,642 B1
(45) Date of Patent: Mar. 13, 2001

(54) REVERSIBLE RATCHETING POWER TOOL WITH SYNCHRONIZED MOTOR AND RATCHET CONTROL

(75) Inventors: Thomas P. Becker, Kenosha; Joshua M. Beer, Racine; Dennis A. Nowak, Greendale, all of WI (US)

(73) Assignee: Snap-on Tools Company, Kenosha, WI (US)

( * ) Notice: Subject to any disclaimer, the term of this patent is extended or adjusted under 35 U.S.C. 154(b) by 0 days.

(21) Appl. No.: 09/347,720

(22) Filed: Jul. 6, 1999

(51) Int. Cl.[7] ..... E21B 17/22

(52) U.S. Cl. ..... 173/217; 173/216; 173/29; 200/1 V; 310/50

(58) Field of Search ..... 173/217, 216, 173/178; 200/29, 1 R, 336, 9, 565; 318/293; 81/57.11, 60, 62; 310/47, 50

(56) References Cited

U.S. PATENT DOCUMENTS

| | | | | |
|---|---|---|---|---|
| 2,031,133 | | 2/1936 | Shumann | 81/476 |
| 2,715,955 | | 8/1955 | Stone | 81/62 |
| 2,773,370 | | 12/1956 | Intraub et al. | 81/474 |
| 2,979,089 | | 4/1961 | Piesker | 81/57.11 |
| 3,802,518 | * | 4/1974 | Albert | 173/217 |
| 3,813,983 | * | 6/1974 | Paul | 81/57.11 |
| 3,905,429 | * | 9/1975 | Berger | 173/216 |
| 4,448,098 | | 5/1984 | Totsu | 81/57.11 |
| 4,459,522 | * | 7/1984 | Huber | 318/293 |
| 4,543,515 | * | 9/1985 | Suzuki | 318/293 |
| 4,558,189 | * | 12/1985 | Dibbern, Jr. et al. | 200/1 V |
| 4,635,502 | | 1/1987 | George | 81/57.22 |
| 4,678,871 | * | 7/1987 | Wong | 200/1 V |
| 4,754,669 | * | 7/1988 | Verdier et al. | 81/60 |
| 4,756,216 | * | 7/1988 | Lo | 173/178 |
| 4,777,852 | | 10/1988 | Herman et al. | 81/63.1 |
| 4,974,475 | | 12/1990 | Lord et al. | 81/60 |
| 5,089,729 | * | 2/1992 | Moores, Jr. | 310/50 |
| 5,178,046 | | 1/1993 | Matsumoto et al. | 173/216 |
| 5,251,706 | | 10/1993 | Ebans | 173/217 |
| 5,311,949 | * | 5/1994 | Chapin | 173/217 |
| 5,653,296 | | 8/1997 | Fujiyama | 173/217 |
| 5,701,961 | | 12/1997 | Warner et al. | 173/217 |

FOREIGN PATENT DOCUMENTS

| | | |
|---|---|---|
| 2408431 | 7/1979 | (FR) . |
| 4642559 | 12/1971 | (JP) . |

* cited by examiner

*Primary Examiner*—Peter Vo
*Assistant Examiner*—Jim Calve
(74) *Attorney, Agent, or Firm*—Seyfarth Shaw

(57) ABSTRACT

A reversible ratcheting electric power tool has a reversible DC electric motor having an output coupled to drive a drive shaft through a reversible ratchet assembly. The tool housing has a reversing mechanism which includes a manually operable reversing cap rotatable about the axis of the drive shaft for controlling the ratcheting direction of the ratchet assembly, the cap having a pair of projections which respectively engage the actuator buttons of two direction control microswitches coupled through an on-off switch to a battery. When the ratchet assembly is in a neutral or non-ratcheting condition, both microswitches are in a normal deactuated condition connecting both of the motor terminals to the battery negative terminal. When the selector cap shifts the ratchet assembly to a forward ratcheting condition, one microswitch is actuated to connect one of the motor terminals to the battery positive terminal, and when the selector is moved to a reverse ratcheting direction, it actuates the other microswitch to connect the other motor terminal to the battery positive terminal.

14 Claims, 2 Drawing Sheets

REVERSIBLE RATCHETING POWER TOOL WITH SYNCHRONIZED MOTOR AND RATCHET CONTROL

BACKGROUND OF THE INVENTION

The invention relates to electrically driven power tools, such as rotary drivers and, in particular, to ratcheting-type drivers.

It is known to provide an electrically driven screwdriver which is of the ratcheting type. Such a power tool is disclosed, for example, in U.S. Pat. No. 4,448,098, and includes a battery-powered, reversible, DC electric motor. The ratchet mechanism is controlled by a selector cap which also simultaneously actuates a single reversible direction control switch for reversing the motor direction simultaneously with reversing of the ratchet direction. This arrangement permits a fastener to be run down by the use of the electric motor and, when the torque increases, final tightening can be performed manually, the manual operation being facilitated by the ratchet mechanism. However, if the single direction-control switch fails, the motor cannot be operated.

U.S. Pat. No. 2,979,089 discloses a battery-powered portable electric screwdriver, with a reversible motor controlled by a control circuit which includes two direction-control switches. However, the switches are ganged, and both switches must be operated to change the motor direction. Thus, if either switch fails, the motor cannot be operated in either direction.

SUMMARY OF THE INVENTION

It is a general object of the invention to provide an improved reversible ratcheting electric power tool which avoids the disadvantages of previous power tools while affording additional structural and operating advantages.

An important feature of the invention is the provision of a power tool of the type set forth which reliably changes motor direction simultaneously with change of ratchet direction.

In connection with the foregoing feature, another feature of the invention is the provision of a power tool of the type set forth, which includes independently operable direction control switches.

Another feature of the invention is the provision of a power tool of the type set forth, which is of relatively simple and economical construction.

Certain ones of these and other features of the invention may be attained by providing a reversible ratcheting electric power tool comprising: a reversible electric motor having an output, a reversible ratchet assembly coupled to the output of the motor and adapted to be coupled to an associated driving device, a manually operated reversing mechanism coupled to the ratchet assembly for selectively controlling the ratcheting direction thereof, an electric control circuit coupled to the motor and including two direction control switches each having a normal deactuated condition and being operable to an actuated condition, said switches respectively controlling forward and reverse directions of operation of the motor, and two switch actuators carried by said reversing mechanism for respectively actuating said direction control switches one at a time substantially simultaneously with selection of the ratcheting direction so that the motor direction is compatible with the ratcheting direction.

Other features of the invention may be attained by providing a power tool of the type described, wherein the motor is normally connected to only one terminal of the DC power source.

Still other features of the invention may be attained by providing a power tool of the type set forth, wherein the direction control switches are single-pole, double-throw switches and wherein the motor is connected to the movable contacts of the switches.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
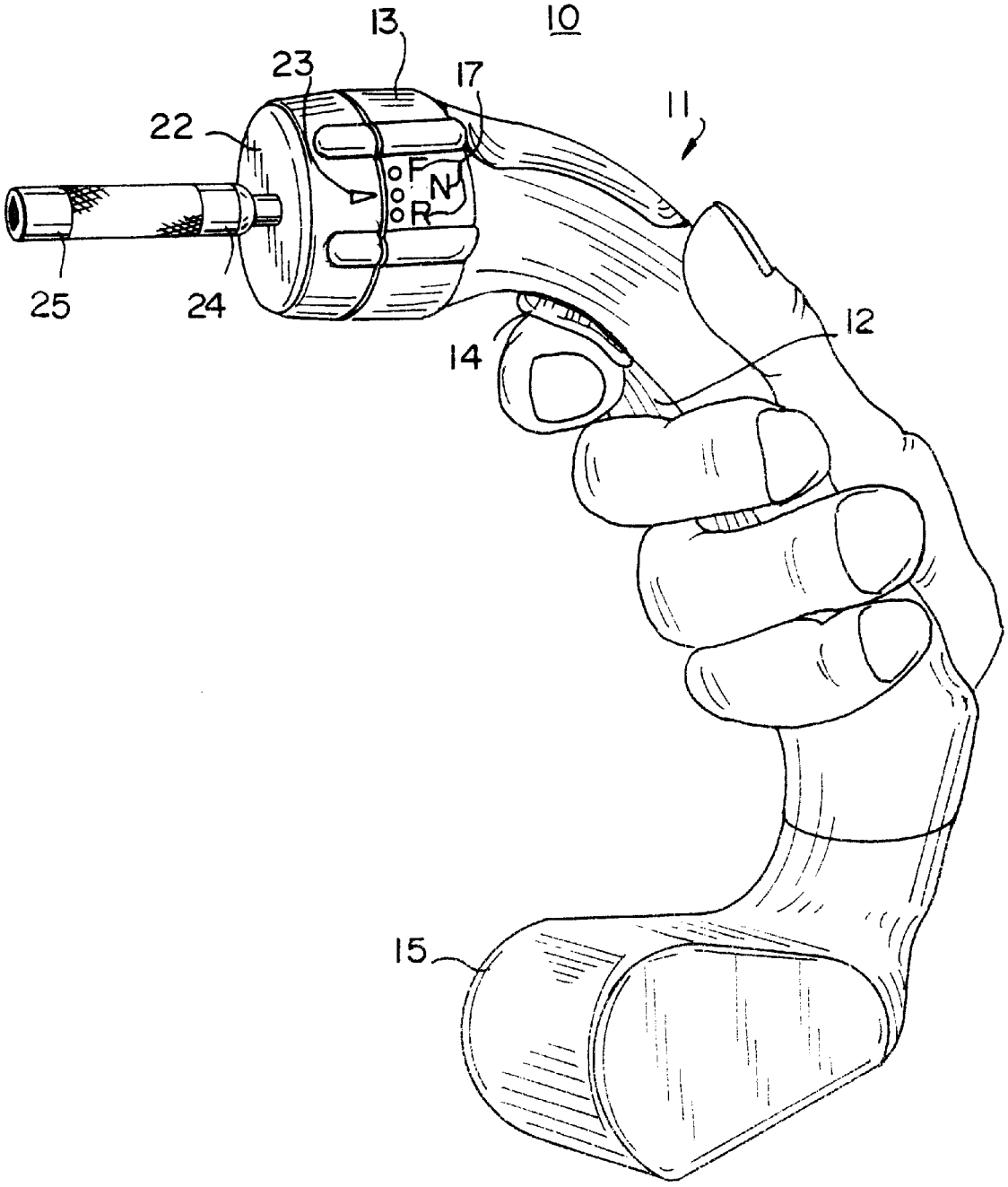
FIG. 1 is a front perspective view of a power tool in accordance with the present invention.

Referring to FIG. 1, there is illustrated a power tool 10, in accordance with the present invention, in the nature of a battery-powered ratcheting electric screwdriver. The tool 10 has a housing 11 with an elongated handle portion 12 and a head portion 13 projecting from one end of the handle portion 12 at an obtuse angle thereto. The handle portion 12 is adapted to be grasped by a user's hand and includes a trigger button 14 engageable by the user's index finger for controlling an ON-OFF switch, in a manner to be described more fully below. A reversible DC electric motor 30 (see FIGS. 4 and 5) is mounted in the handle portion 12 of the housing 11 and is adapted to be powered by one or more battery cells contained in a battery pack 15 adapted to be mounted on the other end of the handle portion 12. Indicia 17 may be provided on the head portion 13 for indicating forward ("F"), reverse ("R"), and neutral or non-ratcheting ("N") conditions of operation.

Figure 2:
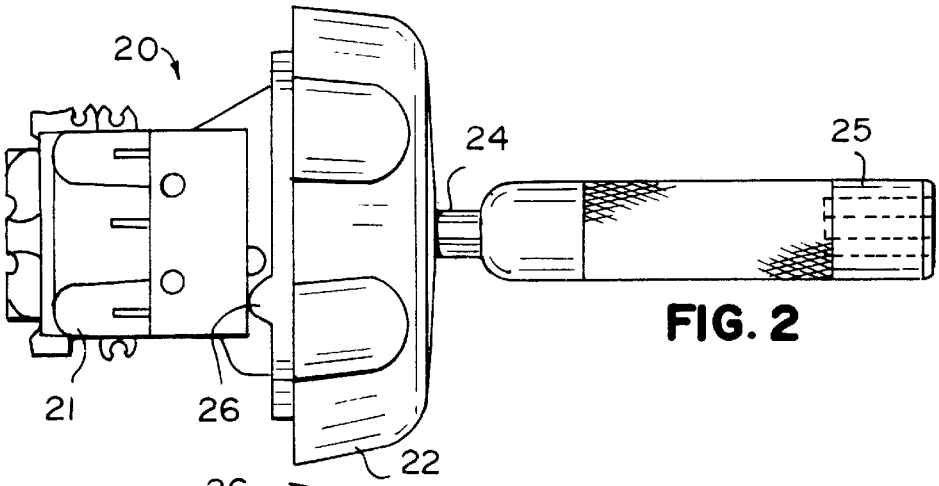
FIG. 2 is an enlarged, side elevational view of the ratchet assembly and reversing mechanism therefor of the tool of claim 1.
Figure 3:
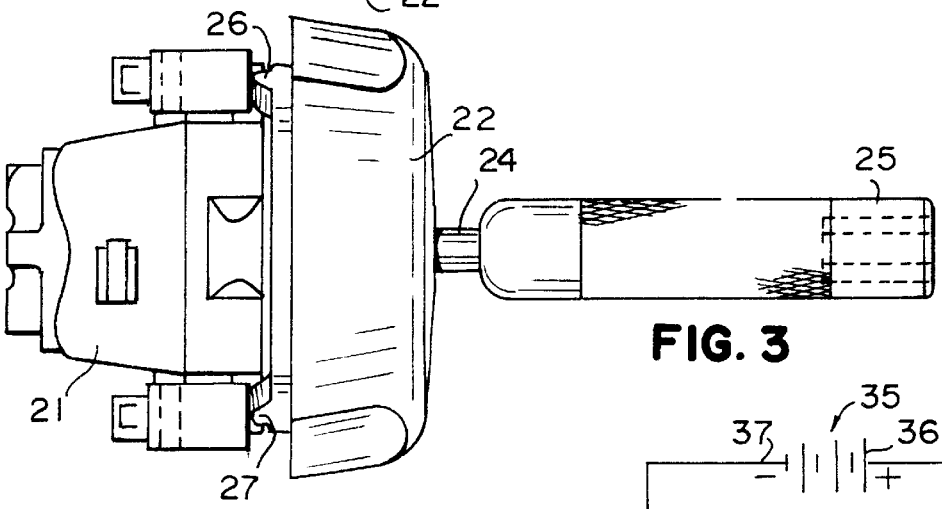
FIG. 3 is a top plan view of the structure illustrated in FIG. 2.

Referring also to FIGS. 2 and 3, a ratchet assembly 20 is disposed in the head portion 13 and includes a housing 21 which encloses the ratchet mechanism, and a reversing cap 22 having a selector indicium 23 thereon for cooperation with the indicia 17 to indicate the selected condition of operation, in a known manner. In assembly, the housing 11 may be of two-part construction, with the parts secured together, as by fasteners or the like, to clamp therebetween the ratchet assembly 20 in a mounted condition with the reversing cap 22 disposed adjacent to the head portion 13, as illustrated in FIG. 1. The ratchet assembly 20 has a drive shaft 24 which projects forwardly through a central opening in the reversing cap 22 and carries a socket 25 for engagement with an associated fastener or tool bit, such as a screwdriver bit. Integral with the reversing cap 22 and projecting rearwardly therefrom at circumferentially spaced-apart locations are two actuator projections 26 and 27, for a purpose to be explained below.

The reversing cap 22 is rotatable relative to the ratchet assembly 20 about the axis of the shaft 24 among three different operating positions, viz., a central neutral or non-ratcheting condition, wherein the tool 10 can be operated manually like a standard screwdriver, a forward ratcheting position, and a reverse ratcheting position, all in a well-known manner. In this regard, the ratchet mechanism of the ratchet assembly 20 may be of the type disclosed in U.S. Pat. No. 4,777,852, the disclosure of which is incorporated herein by reference.

The inner end of the shaft 24 is adapted to be coupled to the output shaft of the DC motor 30. In this regard, the motor 30 is a reversible electric motor, operable in a forward direction when the ratchet assembly 20 is in its forward ratcheting condition for driving the shaft 24 in a clockwise direction, as viewed by the user, and operable in a reverse direction when the ratchet assembly 20 is in its reverse ratcheting condition for driving the shaft 24 in a counter-clockwise direction, as viewed by the user. The motor 30 has terminals 31 and 32 and is powered by a battery 35, which may have multiple cells, and has a positive terminal 36 and a negative terminal 37.

In order to ensure that the motor direction is at all times compatible with the ratcheting direction, there is provided a control circuit 40, which includes a reverse control microswitch 41 which is a single-pole, double-throw ("SPDT") switch having an actuator button 41*a* and terminals 42, 43 and 44. There is also provided a forward control SPDT microswitch 45 having an actuator button 45*a* and terminals 46, 47 and 48. There is also provided an ON-OFF microswitch 49 with an actuator button 49*a*. Each of the switches 41, 45 and 49 may be of the same type, wherein the actuator buttons are spring-biased to an extended position corresponding to the normal switch condition, and wherein the condition or "throw" of the switch is changed as long as the actuator button is depressed. However, in the case of the microswitch 49, one of the fixed contact terminals is not used. It will be appreciated that the actuator button 49*a* of the microswitch 49 is mechanically connected to the trigger 14, so that depression of the trigger 14 closes the switch 49.

Figure 4:
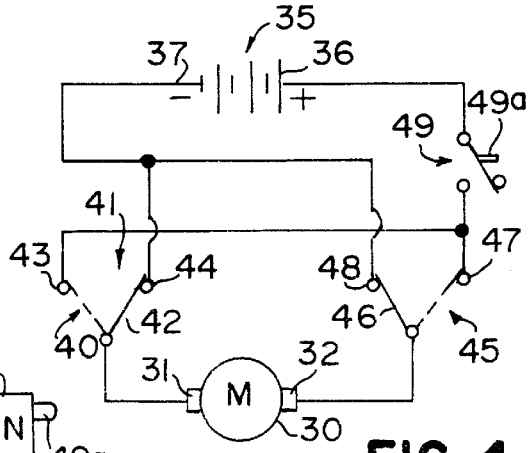
FIG. 4 is a schematic electric circuit diagram of the control circuit for the power tool of FIG. 1.
Figure 5:
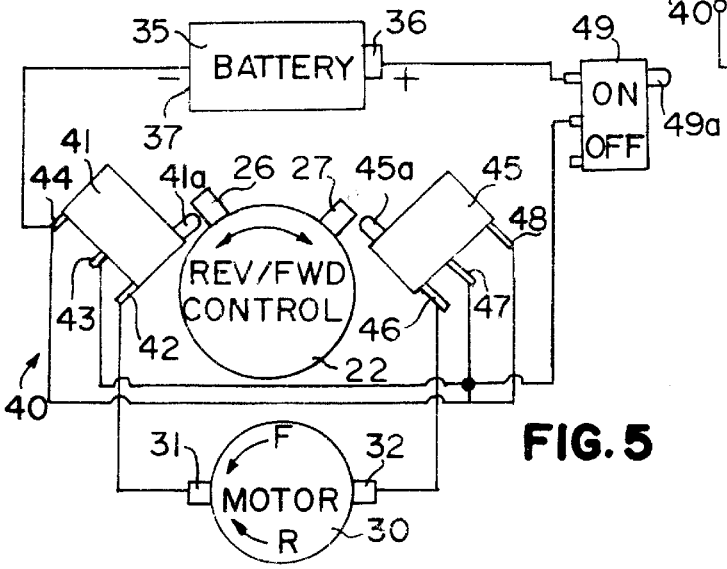
FIG. 5 is a wiring circuit diagram of the control circuit for the power tool of FIG. 1.

As can be seen in FIGS. 4 and 5, the terminals 42 and 46 of the switches 41 and 45, respectively, correspond to the movable contacts of the switches and are, respectively, connected to the terminals 31 and 32 of the motor 30. The terminals 44 and 48 correspond to one set of fixed contacts and are both connected to the negative terminal of the battery, while the terminals 43 and 47 correspond to another set of fixed contacts and are both connected, through the ON-OFF switch 49, to the positive terminal of the battery.

FIGS. 4 and 5 illustrate the reversing cap 22 and the control circuit 40 in a condition corresponding to the neutral or non-ratcheting condition. In this condition, since both motor terminals are connected to the same battery terminal, the motor 30 is deactuated, irrespective of whether or not the ON-OFF switch 49 is closed. Thus, the motor 30 cannot be operated when the tool 10 is in its non-ratcheting or manually operable condition.

If it is desired to operate the motor 30 in a forward direction, the selector or reversing cap 22 is rotated to the forward position, wherein the indicium 23 is aligned with the "F" indicium 17, thereby shifting the ratchet assembly 20 to its forward ratcheting condition. This movement of the reversing cap 22 will cause the projection 27 to depress the actuator button 45*a* of the microswitch 45, shifting its condition to the position illustrated in broken line in FIG. 4, to bring the movable contact 46 into engagement with the fixed contact 47, thereby connecting the motor terminal 32 to the ON-OFF switch 49. Thus, when the trigger button 14 is depressed, closing the ON-OFF switch 49, the motor 30 will be connected across the battery 35 for operation in a forward direction.

If it is desired to operate the motor 30 in a reverse direction, the reversing cap 22 is moved to the position wherein the indicium 23 is aligned with the "R" indicium 17, shifting the ratchet assembly 20 to its reverse ratcheting condition. This movement causes the projection 26 to depress the actuator button 41*a* of the microswitch 41, shifting its condition to the position illustrated in broken line in FIG. 4, to bring the movable contact 42 into engagement with the fixed contact 43, thereby connecting the motor terminal 31 to the ON-OFF switch 49. Accordingly, when the ON-OFF switch 49 is closed, the motor 30 is connected across the battery 35 for operation in the reverse direction. Thus, the motor 30 cannot be operated in a direction inconsistent with the ratcheting direction. It will be appreciated that the reversing cap 22 is provided with a detent mechanism so that it is resiliently retained in each of its selected positions.

From the foregoing, it can be seen that there has been provided an improved reversible, ratcheting, electric power tool, in which the operational directions of the ratchet mechanism and the motor are synchronized, and wherein the control circuitry for the motor is reliable and of simple and economical construction.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A reversible ratcheting electric power tool adapted to be coupled to a source of electric power having two source terminals, the tool comprising:

a reversible electric motor having an output and two motor terminals, a reversible ratchet assembly coupled to the output of the motor and adapted to be coupled to an associated driving device, a manually operated reversing mechanism coupled to the ratchet assembly for selectively controlling the ratcheting direction thereof, an electric control circuit coupled to the motor terminals and including two direction control switches each having a normal deactuated condition in which the direction control switches are disposed for respectively connecting both of the motor terminals to one of the source terminals, and being operable to an actuated condition in which the direction control switch is disposed for connecting an associated motor terminal to the other of the source terminals, the switches respectively controlling forward and reverse directions of operation of the motor, and two switch actuators carried by the reversing mechanism for respectively actuating the direction control switches one at a time substantially simultaneously with selection of the ratcheting direction, so that the motor direction is compatible with the ratcheting direction, the electric control circuit including an on-off switch connected in circuit with the direction control switches and adapted to be connected to the associated source of electric power, each of the direction control switches and the on-off switch being actuatable independently of the others.

2. The power tool of claim 1, and further comprising a portable source of electric power carried by the tool.

3. The power tool of claim 2, wherein the source includes a battery.

4. The power tool of claim 1, wherein each of the direction control switches is a single-pole, double-throw switch.

5. The power tool of claim 4, wherein each of the direction control switches is a microswitch.

6. The power tool of claim 1, wherein the reversing mechanism includes a selector member manually movable between forward and reverse ratcheting conditions, each of the switch actuators including a projection carried by the selector member and engageable with the corresponding one of the direction control switches.

7. A reversible ratcheting electric power tool comprising:

a reversible DC electric motor having an output and first and second motor terminals, a source of DC electric power having first and second source terminals, a reversible ratchet assembly coupled to the output of the motor and adapted to be coupled to an associated driving device, a manually operated reversing mechanism coupled to the ratchet assembly for selectively controlling the ratcheting direction thereof, an electric control circuit coupled to the motor and including two direction control switches for respectively controlling forward and reverse directions of operation of the motor normally connecting both of the motor terminals to the first source terminal, and switch actuator structure carried by the reversing mechanism for actuating a selected one of the switches to connect the motor across the DC source in either (a) a forward condition with the first motor terminal connected to the second source terminal when the ratchet assembly is set for a forward ratcheting direction, or (b) a reverse condition with the second motor terminal connected to the second source terminal when the ratchet assembly is set for a reverse ratcheting direction, the electric control circuit including an on-off switch connected in circuit with the direction control switches and adapted to be connected to the source of electric power, each of the direction control switches and the on-off switch being actuable independently of the others.

8. The power tool of claim 7, wherein the actuator structure includes two actuators for respectively actuating the direction control switches.

9. The power tool of claim 8, wherein the actuators are arranged to operate the direction control switches one at a time.

10. The power tool of claim 9, wherein the reversing mechanism includes a selector member manually movable between forward and reverse ratcheting conditions, each of the switch actuators including a projection carried by the selector member and respectively with a corresponding one of the direction control switches.

11. A reversible ratcheting electric power tool comprising:

a reversible electric motor having an output and two motor terminals a reversible ratchet assembly coupled to the output of the motor and adapted to be coupled to an associated driving device, a manually operated reversing mechanism coupled to the ratchet assembly for selectively controlling the ratcheting direction thereof, an electric control circuit coupled to the motor and including two direction control switches each having a movable contact and two fixed contacts for controlling forward and reverse directions of operation of the motor, the movable contacts being connected to the motor and the fixed contacts being connectable to a source of electric power having two source terminals, and two switch actuators carried by the reversing mechanism for respectively actuating the direction control switches substantially simultaneously with selection of the ratcheting direction so that the motor direction is compatible with the ratcheting direction, each of the direction control switches having a normal deactuated condition in which the direction control switches are disposed for respectively connecting both of the motor terminals to one of the source terminals, each of the direction control switches having an actuated condition in which the direction control switch is disposed for connecting an associated motor terminal to the other of the source terminals, the electric control circuit including an on-off switch connected in circuit with the direction control switches and adapted to be connected to the source of electric power, each of the direction control switches and the on-off switch being actuatable independently of the others.

12. The power tool of claim 11, wherein the motor is a DC motor.

13. The power tool of claim 12, and further comprising a battery having positive and negative terminals, the control circuit having a normal deactuated condition in which the motor is connected only to the negative battery terminal.

14. The power tool of claim 11, wherein the reversing mechanism includes a selector member manually movable between forward and reverse ratcheting conditions, each of the switch actuators including a projection carried by the selector member and engageable with a corresponding one of the direction control switches.

* * * * *

UNITED STATES PATENT AND TRADEMARK OFFICE

CERTIFICATE OF CORRECTION

PATENT NO. : 6,199,642
DATED : March 13, 2000
INVENTOR(S) : Thomas P. Becker et al.

It is certified that error appears in the above-identified patent and that said Letters Patent is hereby corrected as shown below:

Column 5,
Line 59, "actuable" should be -- actuatable --.

Column 6,
Line 12, "after "terminals" insert -- , --.

Signed and Sealed this

Twenty-first Day of August, 2001

*Attest:*

Nicholas P. Godici

NICHOLAS P. GODICI
*Acting Director of the United States Patent and Trademark Office*

*Attesting Officer*